US005988298A

United States Patent [19]

Cheng et al.

[11] Patent Number: 5,988,298

[45] Date of Patent: Nov. 23, 1999

[54] DRILL ROD POSITION STABILIZING DEVICE

[75] Inventors: Eugene Y. T. Cheng; J. George Land, III, both of Roanoke, Va.

[73] Assignee: Ingersoll-Rand Company, Woodcliff Lake, N.J.

[21] Appl. No.: 08/931,678

[22] Filed: Sep. 16, 1997

Related U.S. Application Data

[60] Provisional application No. 60/037,913, Mar. 12, 1997.

[51] Int. Cl.[6] ..... B23Q 5/00

[52] U.S. Cl. ..... 173/147; 173/141

[58] Field of Search ..... 173/147, 156, 173/141, 152; 175/220

[56] References Cited

U.S. PATENT DOCUMENTS

| | | | |
|---|---|---|---|
| 2,333,487 | 11/1943 | Nast | 173/141 |
| 2,661,189 | 12/1953 | Gillerstrom | 173/147 |
| 2,726,065 | 12/1955 | Feucht | 173/147 |
| 2,788,194 | 4/1957 | Hale | 173/147 |
| 3,078,932 | 2/1963 | Nixon | 173/147 |
| 3,642,075 | 2/1972 | Wills | 173/147 |
| 3,732,935 | 5/1973 | Gibson | 173/147 |
| 4,250,973 | 2/1981 | Hall | 173/147 |
| 4,972,911 | 11/1990 | Rajakallio | 175/220 |

*Primary Examiner*—Peter Vo
*Assistant Examiner*—James P. Calve
*Attorney, Agent, or Firm*—John J. Selko; Mark A. Ussai

[57] ABSTRACT

A drilling device has a drilling mast and a movable drifter thereon with a drill rod stabilizing device for stabilizing drill rods in position during drilling. The stabilizer travels along the mast along with the drifter, and includes a locking arm that automatically opens and closes the stabilizer to allow passage of drill rods into an out of the drill line from storage, while supporting the drill rods during drilling. In a substantially vertical drilling position, the stabilizer is moved downwardly by gravity, and upwardly by the drifter's drive chain, which is retained in contact with the stabilizer by a pick-up link on the drive chain contacting stop blocks on the stabilizer. In a substantially horizontal drilling position, the stabilizer is moved in a return direction by the pick-up link and stop block combination. The stabilizer is advanced in the opposite direction by the drifter's pick-up link, which is retained in contact with the stabilizer by a pair of spaced-apart rollers on the stabilizer that frictionally contact and retain the pick-up link and stabilizer together.

7 Claims, 6 Drawing Sheets

DRILL ROD POSITION STABILIZING DEVICE

This application claims the benefit of U.S. Provisional Application No. 60/037,913, filed on Mar. 12, 1997.

BACKGROUND OF THE INVENTION

This invention relates generally to crawler mounted rock drills for the construction and mining industry, and more particularly to a device for providing drill rod stabilization in a crawler having a drill tower and a movable drifter positioned thereon. It is often necessary to provide a center guiding device for long drill rods (rod length more than 14 feet or two piece rods joined together by a coupling) in addition to the regular centralizer at drill guide footpiece to prevent the drill rod from buckling during the drilling operation.

To provide a rod on the crawler machine, one prior art approach utilizes a moving guiding device in front of the drifter. The guiding device travels with the same speed as the drifter advance. This type guiding device is usually called a traveling centralizer. One side of the rod's guiding device is always arranged to have an opening in order to provide access for adding or removing drill rods from the drill string to the rod storage racking area. This opening will sometimes let the drill rod jump out off the guiding device during drilling or removal of drill rod from a drill hole.

The foregoing illustrates limitations known to exist in present drill rod guiding devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a traveling drill rod centralizing device for a mobile drill tower having a drill mast, a drill rod changing mechanism, a drifter mechanism movable along the drill mast comprising: (a) a traveling centralizer base bracket movable along the drill mast; (b) a U-shaped drill rod retaining member on the base bracket, the retaining member defining an opening for permitting passage of drill rod into and out of the retaining member; (c) a locking arm means on the base bracket for moving between and open and closed position to block and unblock the opening in the U-shaped retaining member; and (d) means for moving the locking arm means between the open and closed position.

The foregoing and other aspects will become apparent from the following detailed description of the invention when considered in conjunction with the accompanying drawing figures.

BRIEF DESCRIPTION OF THE DRAWING FIGURES

FIG. 1. is a perspective view of a prior art traveling centralizer drill rod stabilizing device on a drill guide mast, with parts removed;

DETAILED DESCRIPTION

Figure 1:
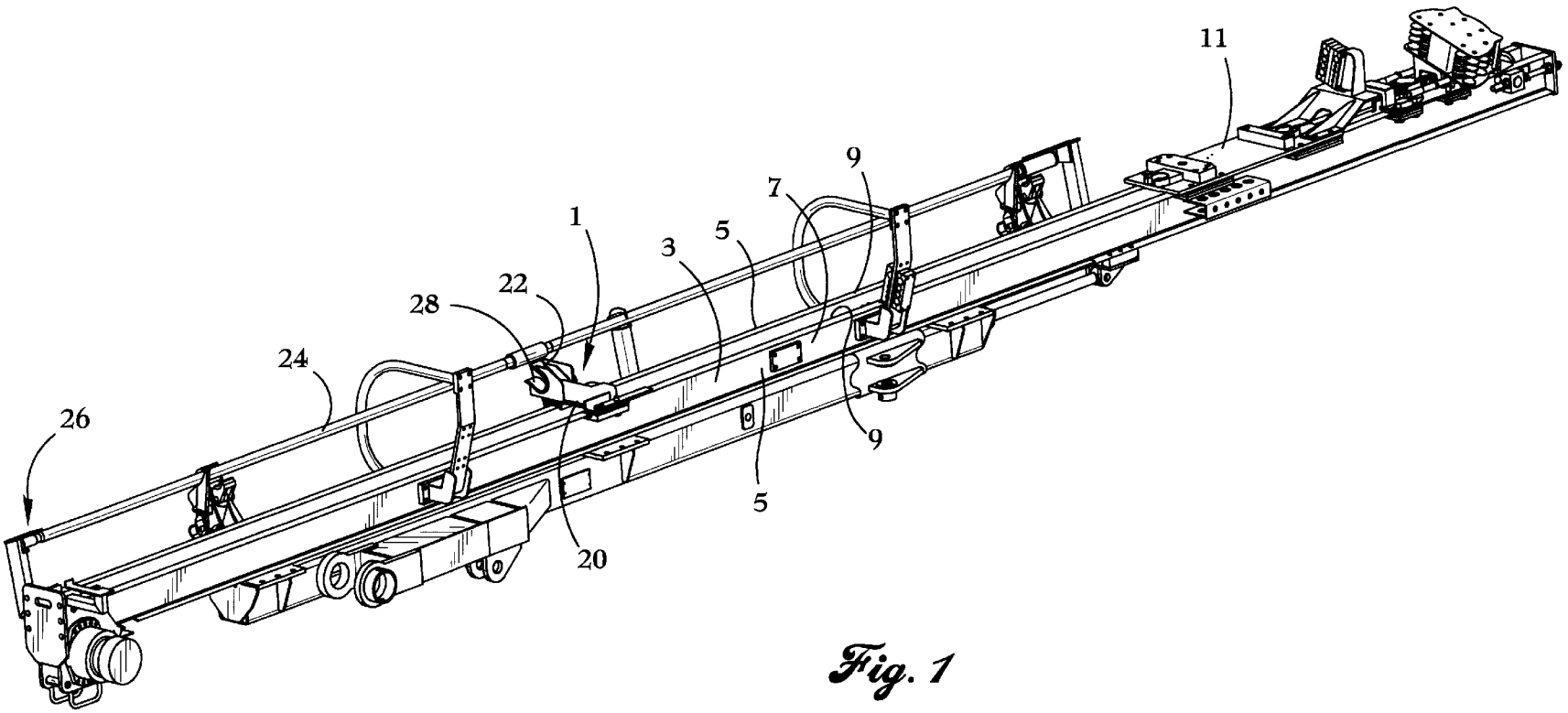
Fig. 1 (PRIOR ART)

FIG. 1 is a rear perspective view of a prior art traveling centralizer drill rod stabilizing device 1 on a drill guide mast 3. Mast 3 is formed by a pair of spaced-apart flanged beams 5, connected together by conventional means. Each beam 5 has a web portion 7 and flanged portions 9, as is conventional. Mounted for sliding movement along mast 3 is a drifter bracket assembly 11 adapted to receive a conventional drifter (not shown).

A traveling centralizer base bracket 20 is mounted for sliding movement along mast 3 in front of the movable drifter on bracket 11. Centralizer bracket 20 moves along with bracket 11, as described hereinafter. Centralizer bracket 20 carries a U-shaped retaining member 22 for retaining therein a drill rod 24. Drill rod 24 is shown in a conventional rod storage device 26 prior to its insertion into the drill string. Retaining member 22 forms an opening 28 for passage of drill rod 24.

Now referring to FIGS. 2–6, the invention is further described. Elements similar to elements described for FIG. 1 carry the same numbers in FIGS. 2–6. Drifter 30 is shown mounted on bracket 11. Permanently mounted to mast 3 is a ramp 32 for activating a locking arm 34 (FIGS. 3-4,6) to move between an open and closed position to block and unblock opening 28 as drifter 30 moves along mast 3.

Figure 3:
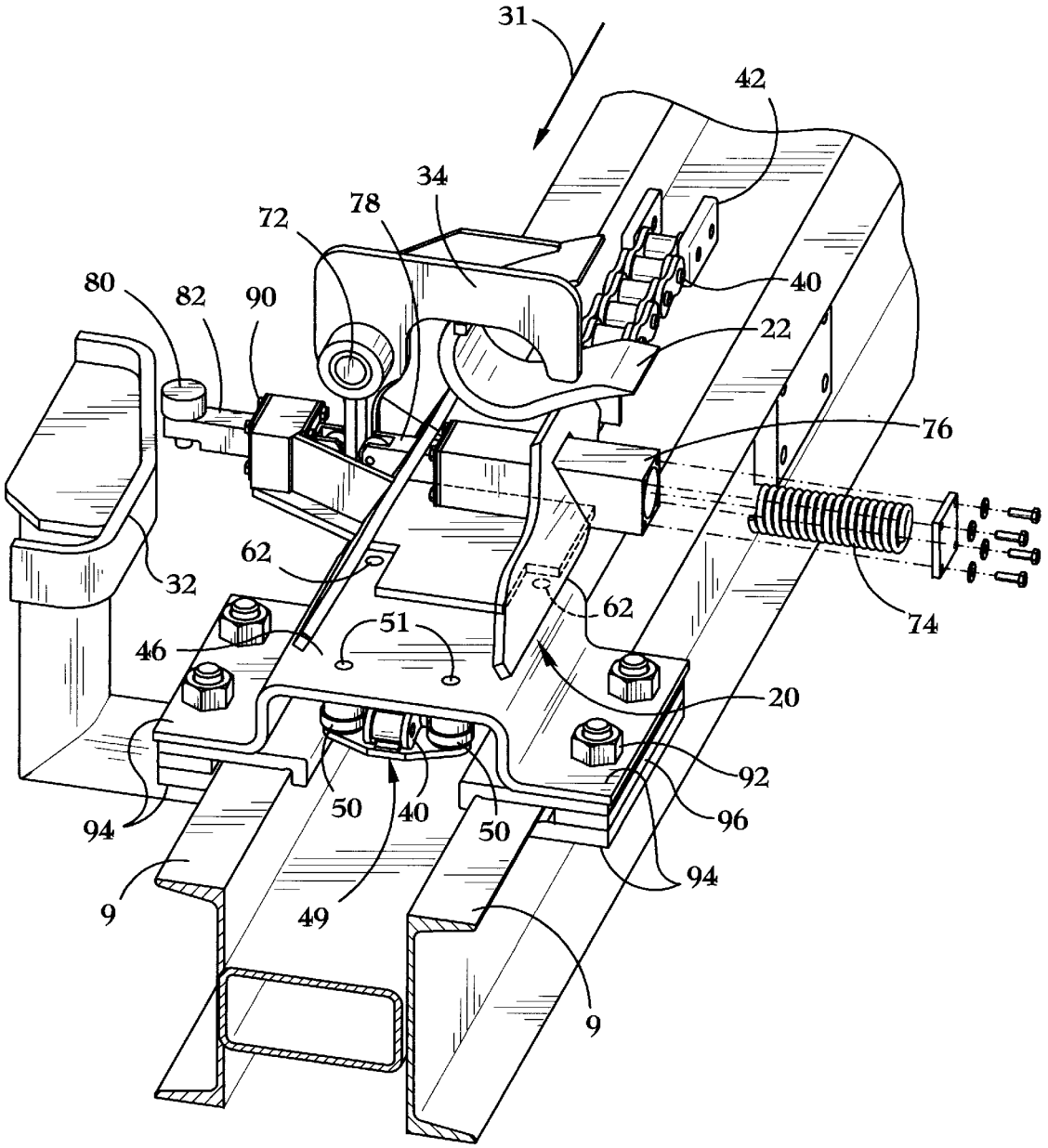
FIG. 3 is a magnified and partially exploded rear perspective view of the traveling drill rod stabilizing device of the invention, on a drill guide mast, with parts removed, with the device in a closed position.
Figure 6:
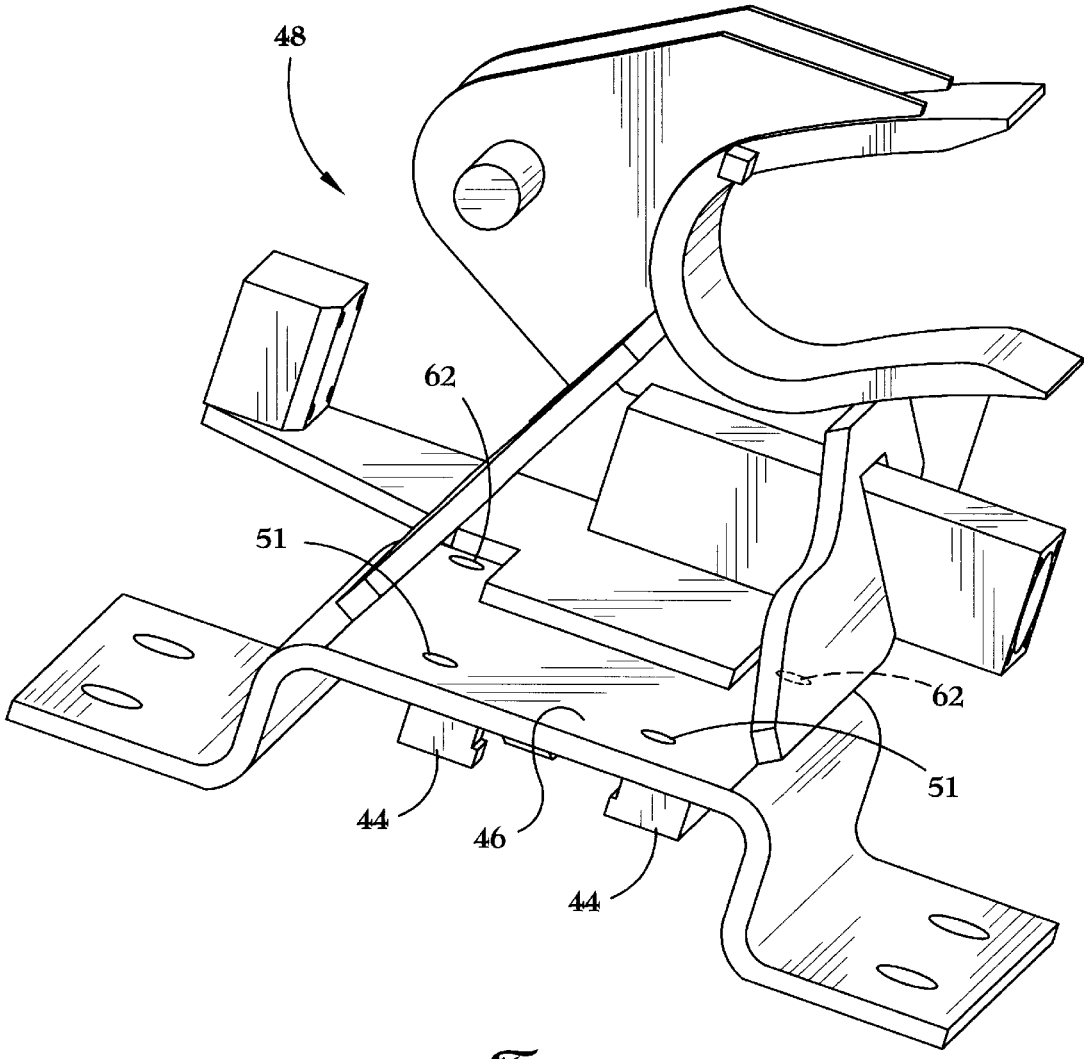
FIG. 6 is a perspective view of a portion of the traveling drill rod stabilizing device showing another view of the base weldment member thereof.

Drive chain 40 moves drifter 30, as is well known. Centralizer bracket 20 moves along mast also, and is moved upwardly(arrow 31) by drive chain 40, which is equipped with a pick-up link 42 that contacts stop blocks 44 welded to the bottom surface of a U-shaped plate 46 of centralizer bracket weldment 48 (FIG. 6). Drive chain 40 passes beneath plate 46 and between a pair of spaced-apart drive chain side guide rollers 50 fastened to plate 46 and a bottom retainer plate 49 (FIG. 3). Rollers 50 rotate about pins 51. Pick-up link 42 is located on the drive chain 40 at a position that is approximately at mid-point of a rod length, for a single rod drill string.

When the mast 3 is vertical, or near vertical, centralizer bracket 20 advances downwardly in front of drifter 30 by gravity, sliding along mast 3 in contact with pick-up link 42. Return, or upward movement, is caused by chain 40 and pick-up link 42 as described above. When the mast is horizontal, or near horizontal, gravity is insufficient to move centralizer bracket 20, and chain 40 must advance drive bracket 20, as now described.

Figure 5:
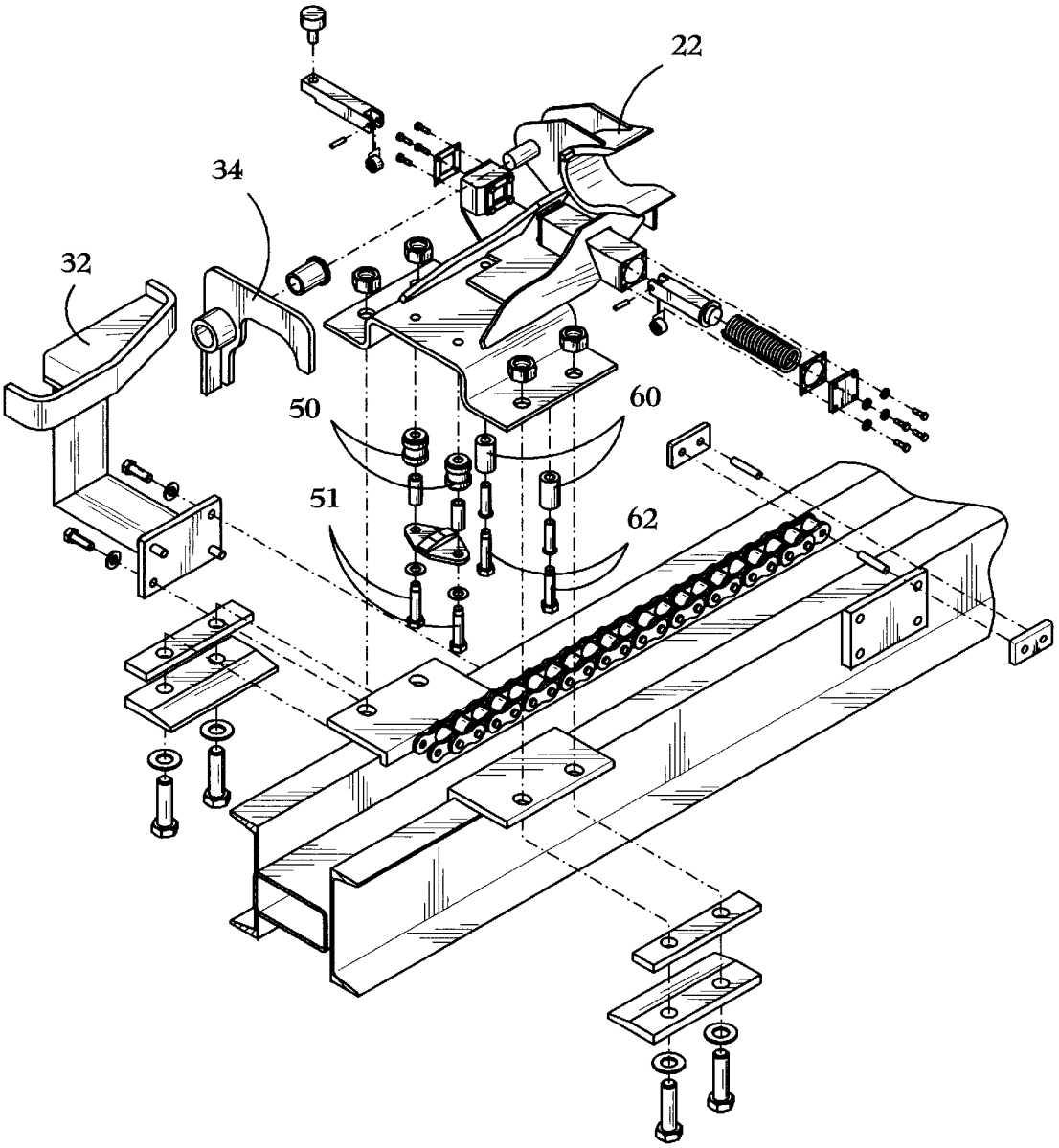
FIG. 5 is a second exploded rear perspective view of the traveling drill rod stabilizing device of the invention, with parts removed.

Drive chain 40 passes between a second pair of spaced-apart drive chain side guide rollers 60 fastened to plate 46 (FIGS. 5 and 6). Rollers 60 rotate about pins 62. Rollers 60 are spaced apart a critical distance so as to frictionally engage the side surfaces of the pick-up link 42, to a degree that will hold the pick-up link 42 and centralizer bracket 20 together, as pick-up link 42 moves in a direction that tends to disengage the pick-up link 42 from stop blocks 44 during an advance.

Figure 4:
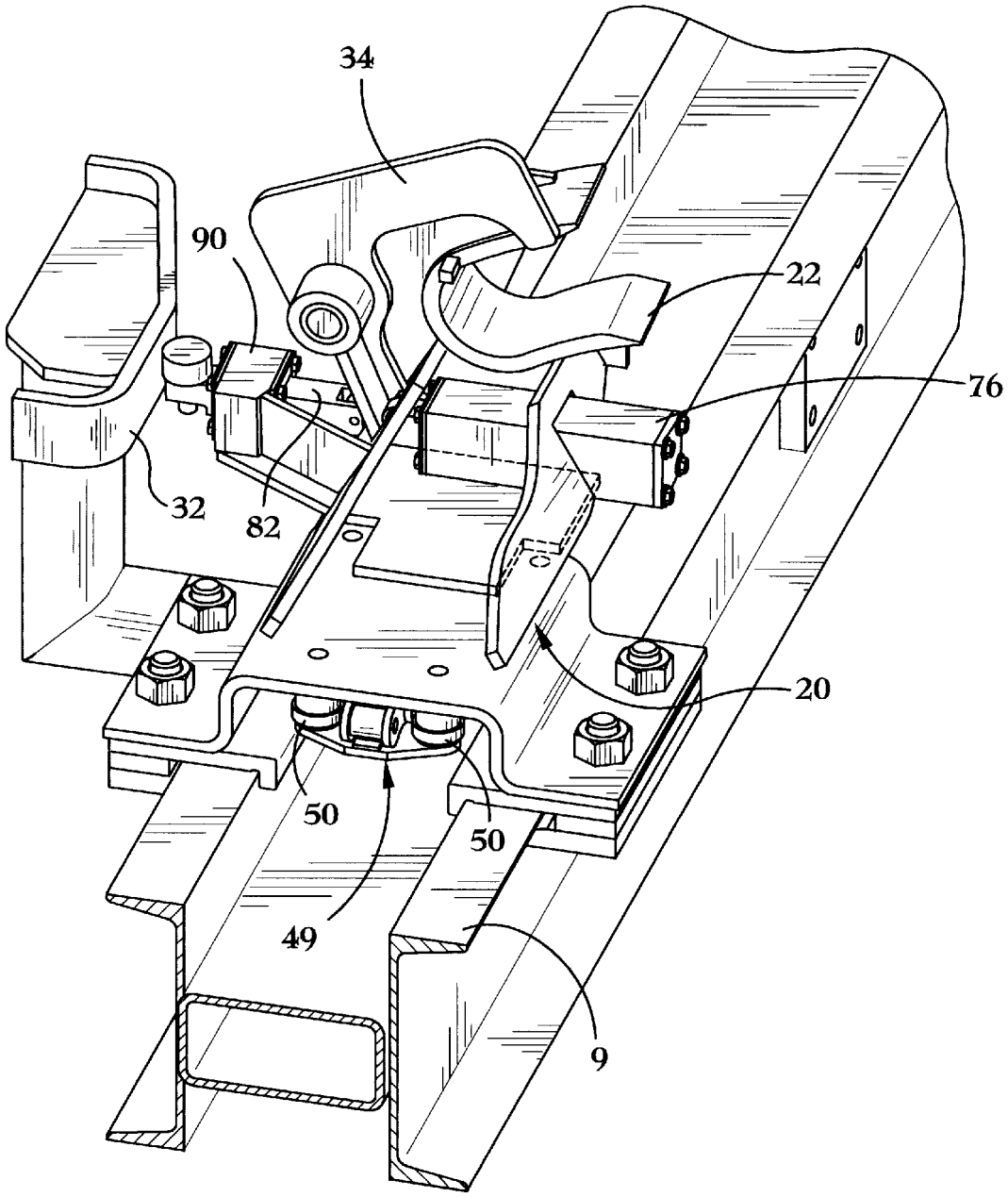
FIG. 4 is a magnified and partially exploded rear perspective view of the traveling drill rod stabilizing device of the invention, on a drill guide mast, with parts removed, with the device in an open position.

During the drilling process, the device traps the drill rod 24 between the U-shaped retaining member 22 and a locking arm 34. Arm 34 can pivot about pivot axis 72 (FIGS. 3 and 4). A pre-loaded plunger spring 74, carried in a closed housing 76, applies a constant pushing force to the passive plunger 78, which in turn keeps the locking arm 34 in the locked position.

When the drifter 30 travels to near the top of the drill mast 3, during the rod changing process, locking arm 34 will be swung up automatically to open the U-shaped member 22. The locking arm 34 is activated by the cam roller 80 of the actuating plunger 82. Roller 80 hits and slides on the ramp 32. Ramp 32 is located on the drill guide mast 3 to force the actuating plunger 82 to travel full stroke when the drifter 30 travels to the position that the drill rod 24 can be swung in or out of the drill string. Locking arm 34 will be at a fully opened position when the actuating plunger 82 is at full stroke position (shown in FIG. 4). As drifter 30 lowers to the start drilling position, the actuating plunger 82 will travel to just below the ramp area so the plunger spring 74 is sprung back to its original pre-load position and forces the locking arm 34 to return to the closed position and, in turn, push the plunger 82 to zero stroke position. Closed housing 76 carries lubricating material for plunger 78. Likewise, a second closed housing 90 carries lubricating material for plunger 82.

Traveling bracket 20 is slidably mounted on flanges 9 by nuts and bolts 92 and retainer plates 94. Wear pads 96 are positioned between retainer plates 94.

Figure 2:
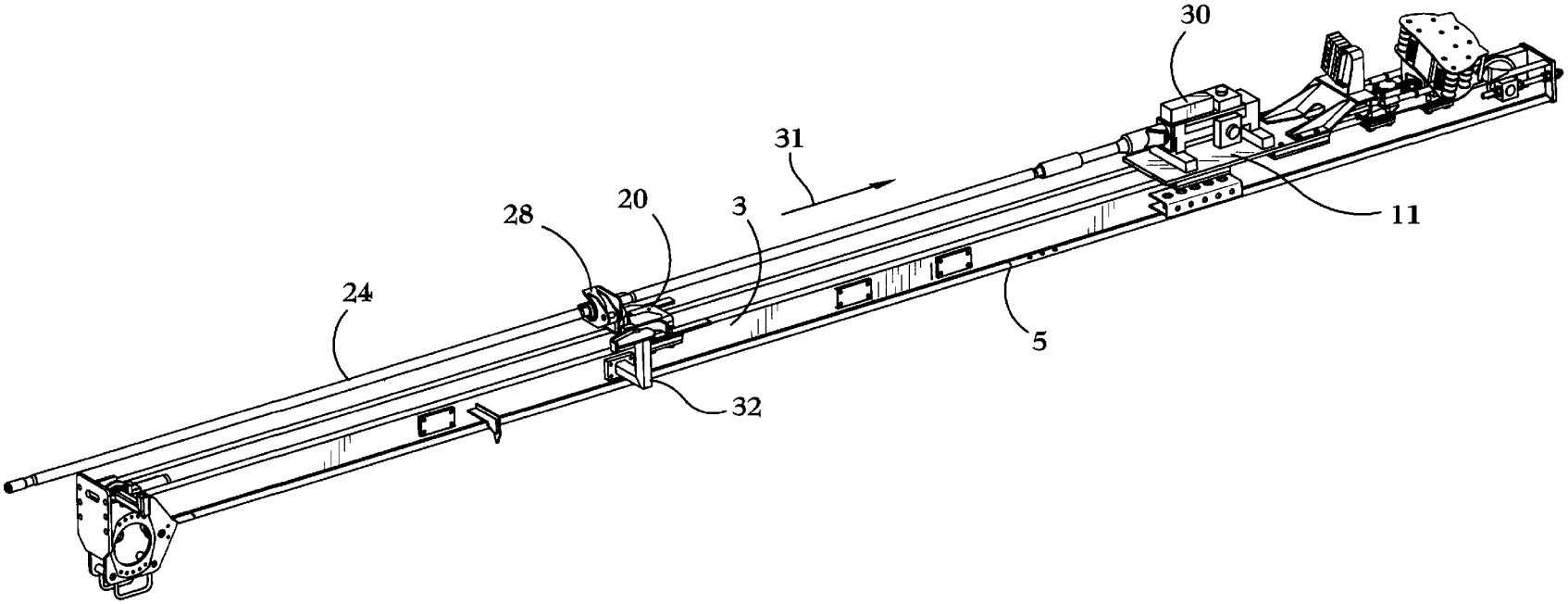
FIG. 2 is a front perspective view of the traveling drill rod stabilizing device of the invention, on a drill guide mast, with parts removed.

For two piece rod drilling system, the traveling centralizer configuration is shown in FIG. 2 to cause the locking area to be located at the coupling location.

Thus, it can be understood that this invention provides a drill rod stabilizing device which is integral with the traveling centralizer. The rod stabilizing device will be automatically opened and closed without any assistance of hydraulic or electrical systems. This stabilizing device can be used with one piece rod drilling system wherein the stabilizing device is caused to lock at the mid-rod area, or used in multiple rod drilling systems wherein the stabilizing device is caused to lock at the coupling area. A conventional centralizer at the drill guide footpiece still provides the main function of centering the drill rod.

We claim:

1. A traveling drill rod centralizing device for a drill tower for use with a plurality of drill rods and having a drill mast, a drill rod changing mechanism, and a drifter mechanism movable along the drill mast, comprising:

(a) a traveling centralizer base bracket movable along said drill mast, said bracket being spaced from and movable with said drifter mechanism along at least a portion of said drill mast;

(b) a drill rod retaining member on said base bracket, said retaining member defining an opening for permitting passage of drill rod into and out of said retaining member, said retaining member movably supporting a section of a drill rod during movement of said drifter mechanism;

(c) a locking arm on said base bracket movable between an open and a closed position to block and unblock said opening in said retaining member; and (d) means for automatically moving said locking arm between said open and said closed positions when said drifter moves along said drill mast including stationary means attached to said drill mast and movable means attached to said base bracket and engageable with said stationary means, wherein said locking arm is moved to said open position when said movable means engages with said stationary means as said drifter moves in an upward direction and said locking arm is moved to said closed position when said movable means disengages from said stationary means as said drifter moves in a downward direction.

2. The drill rod centralizing device of claim 1 further including a first retaining means for retaining a drive chain in contact with said centralizing device to move said centralizing device in a first direction.

3. The drill rod centralizing device of claim 2 further including a second retaining means for retaining a drive chain in contact with said centralizing device to move said centralizing device in a second direction opposite to said first direction.

4. The drill rod centralizing device of claim 3 wherein said first retaining means comprises:

(a) a pick-up link on said drive chain;

(b) stop block means on said base bracket for contacting said pick-up link during movement of said drive chain in said first direction; and (c) a first pair of spaced-apart side drive chain rollers for retaining said drive chain in position with respect to said bracket during movement of said drive chain.

5. The drill rod centralizing device of claim 4 wherein said second retaining means comprises:

(a) a second pair of spaced-apart side drive chain rollers for frictionally contacting said pick-up link to retain said centralizing device in contact with said drive chain during movement thereof in said second direction.

6. The drill rod centralizing device of claim 1 wherein:

said stationary means includes a ramp mounted to said drill mast; and said movable means includes a first plunger movably attached to said base bracket and configured to act upon said locking arm and a cam means attached to said first plunger and contactable with said ramp such that movement of said base bracket in said upward direction causes said first plunger to move said locking arm to said open position.

7. The drill rod centralizing device of claim 6 wherein said movable means further includes:

a second plunger movably attached to said base bracket and configured to act upon said locking arm; and spring means connected with and biasing said second plunger toward said first plunger such that movement of said base bracket in said downward direction causes said second plunger to move said locking arm to said closed position.

* * * * *